US012702893B2

(12) United States Patent
Aksöz et al.

(10) Patent No.: US 12,702,893 B2
(45) Date of Patent: Aug. 11, 2026

(54) SENSOMOTORIC HAND THERAPY DEVICE

(71) Applicant: UNIVERSITÄT BERN, Bern (CH)

(72) Inventors: Efe Anil Aksöz, Bern (CH); Laura Marchal-Crespo, The Hague (NL); Nathan Van Damme, Zele (BE); Raphael Rätz, Thun (CH)

(73) Assignee: UNIVERSITÄT BERN, Bern (CH)

( * ) Notice: Subject to any disclaimer, the term of this patent is extended or adjusted under 35 U.S.C. 154(b) by 84 days.

(21) Appl. No.: 18/866,452

(22) PCT Filed: May 16, 2023

(86) PCT No.: PCT/EP2023/063100
§ 371 (c)(1),
(2) Date: Nov. 15, 2024

(87) PCT Pub. No.: WO2023/222678
PCT Pub. Date: Nov. 23, 2023

(65) Prior Publication Data

US 2025/0319346 A1 Oct. 16, 2025

(30) Foreign Application Priority Data

May 17, 2022 (CH) ..... 594/2022

(51) Int. Cl.
*A63B 21/00* (2006.01)

(52) U.S. Cl.
CPC .... *A63B 21/4019* (2015.10); *A63B 21/00178* (2013.01)

(58) Field of Classification Search
CPC . A61H 1/00; A61H 1/008; A61H 1/02; A61H 2205/065; A61H 2205/067;
(Continued)

(56) References Cited

U.S. PATENT DOCUMENTS 6,324,557 B1 * 11/2001 Chan ..... G06F 15/0208 708/142
6,955,442 B1 * 10/2005 Chan ..... G02B 25/02 362/199
(Continued)

FOREIGN PATENT DOCUMENTS

CN 201058205 Y * 5/2008
CN 202235783 U 5/2012
(Continued)

OTHER PUBLICATIONS

Written Opinion and International Search Report issued Aug. 31, 2023 in Intl. Appl. No. PCT/EP2023/063100.

*Primary Examiner* — Zachary T Moore
(74) *Attorney, Agent, or Firm* — MEDLER FERRO WOODHOUSE & MILLS PLLC

(57) ABSTRACT

The present invention relates to a sensomotoric hand therapy device comprising a flexible shell having a first leg portion configured to accommodate fingers of a hand of a patient, a second leg portion configured to accommodate a thumb of the patient and a U-shaped portion configured to accommodate a metacarpus of the patient. The device further comprises a first reinforced member connected to a distal end region of the first leg portion of the shell, a second reinforced member connected to a distal end region of the second leg portion of the shell and a third reinforced member connected to and reinforcing the U-shaped portion of the shell. Further, the device comprises a movement mechanism defining a course and resistance of movement of the first reinforced member and the second reinforced member relative to the third reinforced member; and to a respective hand therapy system and hand training method.

21 Claims, 7 Drawing Sheets

(58) Field of Classification Search
CPC ..... A63B 21/4017; A63B 21/4019; A63B 21/4021; A63B 21/00178; A63B 21/00189; A63B 21/028; A63B 21/045; A63B 23/16; G06F 3/033; G06F 3/03543
See application file for complete search history.

(56) References Cited

U.S. PATENT DOCUMENTS

| | | | | |
|---|---|---|---|---|
| 7,537,547 | B1 * | 5/2009 | Hosick | A63B 21/4017 482/45 |
| 10,688,340 | B1 * | 6/2020 | Aldredge | A63B 21/0421 |
| 10,888,486 | B2 * | 1/2021 | Baek | A61H 1/0266 |
| 12,090,364 | B2 * | 9/2024 | Chang Chien | A61H 1/0244 |
| 2012/0065026 | A1 * | 3/2012 | Land | A63B 21/4019 482/47 |
| 2012/0179226 | A1 * | 7/2012 | Graham | A63B 21/0004 607/111 |
| 2012/0323148 | A1 * | 12/2012 | Kaiser | A61H 1/0285 601/5 |
| 2013/0158454 | A1 * | 6/2013 | McFarlane | A61B 17/122 601/70 |
| 2019/0374812 | A1 * | 12/2019 | McGhee | A63B 21/023 |

FOREIGN PATENT DOCUMENTS

| | | | | |
|---|---|---|---|---|
| CN | 204270256 | U | 4/2015 | |
| CN | 205659347 | U | 10/2016 | |
| CN | 215310064 | U | 12/2021 | |
| EP | 2417941 | A1 | 2/2012 | |
| EP | 3895679 | A1 | 10/2021 | |
| KR | 101471805 | B1 | 12/2014 | |
| KR | 102108655 | B1 | 5/2020 | |
| WO | WO-2015057162 | A1 * | 4/2015 | A61B 34/76 |

* cited by examiner

SENSOMOTORIC HAND THERAPY DEVICE

TECHNICAL FIELD

The present invention relates to a handheld therapy device which supports the sensomotoric rehabilitation of a patient's hand after for instance a stroke, a disease, an accident or the like. The present invention also relates to a respective therapy system and training method.

BACKGROUND ART

Stroke is one of the leading causes of adult disabilities in the world, with millions of cases every year. A major part of stroke survivors suffer from hemiparesis, i.e. a paralysis of one side of the body, resulting in a severe decrease in their ability to perform typical activities of daily living (manipulating objects, handwriting, eating, driving, etc.). Impaired finger function resulting from stroke can be summarized as failure to extend fingers, poor finger coordination, loss of finger independence, poor explorative movements, slow and clumsy object manipulation and grasping, and particularly inability to control and maintain constant grip force.

However, the plasticity of the human brain can assist in reorganizing neural connections damaged by the stroke, and thus to slowly partially recover the impaired functions. Rehabilitation is performed after stroke in order to stimulate the recovery, typically by performing intense movement repetition involving the impaired limb. Appropriate rehabilitation programs have to be task-oriented, focused on activities of daily living and repetitive movement oriented to provide an efficient therapy. It is also known that rehabilitation is also critical to other neuropathology injuries (Parkinson disease, spinal cord injuries, traumatic brain injuries, cerebral palsy) and physical rehabilitation.

Compared to classical rehabilitation performed in hospitals and specialized centers, undergoing treatment at home gives people the advantage of practicing skills and developing compensatory strategies in the context of their own living environment. However, home-based rehabilitation programs require specialized equipment for use at both the medical facility and at home. Motivation is also a problem for a subject training alone as he would not take advantage of the group effect.

Devices such as soft balls used in rehabilitation centers are often applied to train finger function in a comparatively simple manner.

In KR 10147805 A1 another device for hand exercise is described. Thereby, a wrist-side palm part of a patient whose fingers are stiff and curled toward the palm, fingers except a thumb of the patient, and a palm part on a side of the fingers except the thumb are spread apart from each other or gathered for an exercise. The device can be applied to easily perform physiotherapy in a medical institution or in everyday life, and can be manufactured in a relatively easy manner at relatively low costs.

However, soft balls and the rather basic hand exercise device mentioned above are incapable of measuring patients' performances and provide them with accurate feedback of their performance.

From EP 3 895 679 A1 a handheld rehabilitation device is known which comprises a housing, an actuator, a battery, a microcontroller and an opening mechanism including at least one opening plate. The opening mechanism comprises at least one axis of rotation, around which the at least one opening plate rotates from a closed position to an open position. The at least one opening plate is rotatably connected to the housing by means of radial bearings and rotates up to a maximum angle of rotation. The actuator, the battery and the microcontroller are preferably included into the housing. Hence, the complete housing fits into the palm of a hand. The microcontroller controls the speed and the maximum angle of rotation of the opening mechanism. Hence, the microcontroller also controls the actuator. The at least one opening plate rotates between the closed position and the open position by means of the actuator. This handheld rehabilitation device may improve the hand functionality in stroke survivors. It may enable passive hand movement to preserve hand functionality and avoid contraction of muscles, which could be used for patients with mid-severe hand function impairments.

Yet, this type of handheld rehabilitation device comprises a rather complex design using multiple sensor types as for example force sensors in the opening plate for force measurement and time of flight sensors for determining the position of the opening plate. In this device however, there is a pinching risk due to the gaps between the moving parts which limits its application for unsupervised training. Further, this device does not guarantee physiological grasps.

Therefore, there is a need for a further improved device with less components, improved hand ergonomics and with enhanced suitability for unsupervised sensory hand rehabilitation as well as for a respective hand therapy system and hand training method.

DISCLOSURE OF THE INVENTION

According to the invention this need is settled by a sensomotoric hand therapy device according to claim 1, a therapy system according to claim 15 and a method for training a hand of a patient according to claim 18. Preferred embodiments are subject of the dependent claims.

In one aspect, the invention relates to a sensomotoric hand therapy device which comprises a flexible shell having a first leg portion configured to accommodate fingers of a hand of a patient, a second leg portion configured to accommodate a thumb of the patient and a U-shaped portion configured to accommodate a metacarpus of the patient. Further, the sensomotoric hand therapy device comprises a first reinforced member which is connected to a distal end region of the first leg portion of the shell, a second reinforced member which is connected to a distal end region of the second leg portion of the shell and a third reinforced member which is connected to and which reinforces the U-shaped portion of the shell. Further, the sensomotoric hand therapy device comprises a movement mechanism which defines a course and a resistance of movement of the first reinforced member and the second reinforced member relative to the third reinforced member.

The term "flexible shell" as used herein includes shells which comprise portions which are fully flexible and portions which are substantially rigid or only flexible to a limited degree.

The "first and second reinforced members" are such substantially rigid portions of the shell which function as stable gripping portions corresponding to the fingertips and the thumb (tip) of a human hand.

The "third reinforced member" is also a substantially rigid portion of the shell which corresponds to the metacarpal bone of a human hand and serves as a support member enabling advantageous ergonomic characteristics, in particular an improved gripability, e.g. for lager diameter power grasps (which is one of the grasps most frequently used when performing activities of daily living (ADL)).

It is noted that in accordance with the present invention, the shell and the reinforced members may be made from the same material, wherein the reinforced members are in the form of locally reinforced rigid portions having a greater wall thickness than the flexible portions of the shell. It is however possible that the flexible portions of the shell are made from a different material than the reinforced members.

Thus, the term "connected to" as used herein includes one-piece shells, i.e. where the reinforced members are made from the same material as the flexible portions of the shell and are arranged at the distal end regions of the first and second leg respectively in the metacarpus area of the shell (i.e. manufactured in one piece), and shells where the reinforced members are made from different material as the flexible portions of the shell and are physically connected to the flexible shell portions by suitable fastening means.

An exemplary material from which the shell may be made by means of, for example, 3D-printing is poly-lactic acid (PLA). Other appropriate plastic materials (but generally also non-plastic materials like metal sheets) are conceivable.

The term "movement mechanism" generally includes gear-driven mechanisms but also other mechanisms which are suited for defining a course of movement and a resistance of movement of the first reinforced member and the second reinforced member relative to the third reinforced member are applicable, as for example an appropriate cable transmission solution.

Preferably, the movement mechanism comprises a motor, in particular an electric motor, to define the resistance of movement of the first reinforced member and the second reinforced member relative to the third reinforced member. In this manner one may achieve a compact design and reduce the overall weight of the sensomotoric hand therapy device.

Preferably, the sensomotoric hand therapy device comprises a control unit, wherein the control unit controls the motor of the movement mechanism to define the resistance of movement of the first reinforced member and the second reinforced member relative to the third reinforced member as a function of a displacement of the first reinforced member and the second reinforced member relative to the third reinforced member. In such control scheme, the interaction force is computed as a function of the user's fingers displacement without measuring the true interaction force between the user and the device. Thus, no additional force sensors are required; however this does require a backdrivable and mechanically transparent transmission. Force sensors may however also be used in the sensomotoric hand therapy device.

Preferably, the control unit controlling the motor comprises controlling a torque of the motor. This has proven to be a very efficient way to compute respective haptic interactions.

Preferably, the movement mechanism comprises a multistage transmission unit for transmitting motor torque force. Advantageously, the transmission unit comprises a first stage being preferably in the form of a belt connection, a second stage being preferably in the form of a first herringbone gear member and a third stage being preferably in the form of a second herringbone gear member. Such transmission solution has proven to be mechanically transparent. Also, such transmission is backdrivable. However, other types of gears, as for example worm gears, may also be suited for the present sensomotoric hand therapy device. Also, cable transmission arrangements may be suited for the present sensomotoric hand therapy device.

Preferably, the transmission unit is connected to the first reinforced member by means of a first connection member being arranged on the first herringbone gear member and to the second reinforced member by means of a second connection member being arranged on the second herringbone gear member. In doing so, the shell endpoints are coupled to the transmission mechanism in a reliable and effective manner. Advantageously, the first connection member and the second connection member are in the form of a rod, in particular an aluminium rod, in order to save weight. Preferably, the rods are movably arranged in curved guiding slits which are provided in a base plate of a transmission box or housing which encloses the transmission components.

Preferably, the belt connection comprises a belt wheel, a motor shaft and a synchronous belt, and wherein further preferably the belt wheel carries a herringbone gear wheel. Hereby, an efficient and place-saving construction can be provided.

Preferably, the belt wheel is operatively connected to the motor shaft by the synchronous belt, wherein the second herringbone gear member meshes with the herringbone gear wheel and wherein the first herringbone gear member meshes with the second herringbone gear member. This results in a particularly transparent transmission.

Preferably, a shaft of the motor has a first diameter, the belt wheel has a second diameter, the gear wheel has a third diameter, the first herringbone gear member has a fourth diameter and the second herringbone gear member has a fifth diameter. In this manner, advantageous transmission ratios may be achieved.

Preferably, the control unit comprises a function for computing a motor torque which includes the product of a relative radius and a resisting force and which defines the resistance of movement. Thereby, the relative radius comprises the sum of an arc radius of the second reinforced member of the shell divided by an overall transmission ratio related to the second reinforced member of the shell and of an arc radius of a first reinforced member of the shell divided by an overall transmission ratio related to the first reinforced member of the shell. This has proven to be a relatively efficient way to determine the motor torque force for a given desired resistive interaction force with regard to the present transmission. In other words, at first a combined displacement is computed. Based on this and on a respective virtual reality hand therapy game, a desired force is then computed. Subsequently, a required motor torque is computed which is needed to make the user feel the force in the game.

Preferably, the overall transmission ratio related to the second reinforced member of the shell is between about 14 and about 22, preferably between about 16 and about 20 and further preferred about 18, and further preferably the overall transmission ratio related to the first reinforced member of the shell is between about 8 and about 16, preferably between about 10 and about 14 and further preferred about 12. For the present solution relatively low transmission ratios are desired, as this has shown to be beneficial for mechanical transparency.

Preferably, the shell is configured to provide a physiological power grasp of the hand of the patient. As already pointed out above, this is one of the grasps most frequently used when performing activities of daily living (ADL) and is effectively trained in clinics.

In another aspect the present invention relates to a therapy system which comprises a sensomotoric hand therapy device as described before and a computer device configured for executing a virtual reality hand therapy game thereon. The use of such sensomotoric hand therapy devices together with motivating VR games in minimally supervised or unsupervised home-based training helps to further motivate patients and increase therapy dosage by providing continuous care. The term "computer devices" as used herein may for example include personal computers, laptop computers, smart phones, tablet computers and the like.

Preferably, the virtual reality hand therapy (or rehabilitation) game is configured to compute a rendered force Fr on the basis of the combined displacement s and speed s of the first reinforced member and the second reinforced member and preferably by further considering parameters representing a virtual spring and a virtual viscous damping. This has proven to be a relatively efficient way to determine the rendered force (i.e. from the movement of thumb and fingertips) in the rehabilitation game.

In another aspect, the present invention relates to a method for training a hand of a patient. The method comprises the steps of providing a sensomotoric hand therapy as described above; providing a computer device with a virtual reality hand therapy game installed thereon; executing a game task by means of a hand avatar on a screen of the computer device, the task requiring specific interaction forces to be applied via the sensomotoric hand therapy device and the hand avatar to a virtually deformable object on the screen of the computer device; and squeezing the virtually deformable object with the hand avatar until a predetermined threshold value for the specific interaction forces has been reached. Advantageously, the virtually deformable object comprises a dispenser filled with a virtual liquid, wherein the dispenser is configured to be squeezed in order to fill a virtual glass arranged underneath the dispenser with the virtual liquid until a maximum fill level has been reached. Preferably, different types of dispensers with varying virtual flexibilities are provided in order to create a comprehensive feedback. Such game training method provides numerous specific advantages, namely low complexity, believability, and adaptability of virtual elements with different rich haptic characteristics.

BRIEF DESCRIPTION OF THE DRAWINGS

The method according to the invention are described in more detail hereinbelow by way of an exemplary embodiment of the present invention and with reference to the attached drawings, in which.

DESCRIPTION OF EMBODIMENTS

In the following description certain terms are used for reasons of convenience and are not intended to limit the invention. The terms "right", "left", "up", "down", "under" and "above" refer to directions in the figures. The terminology comprises the explicitly mentioned terms as well as their derivations and terms with a similar meaning. Also, spatially relative terms, such as "beneath", "below", "lower", "above", "upper", "proximal", "distal", and the like, may be used to describe one element's or feature's relationship to another element or feature as illustrated in the figures. These spatially relative terms are intended to encompass different positions and orientations of the devices in use or operation in addition to the position and orientation shown in the figures. For example, if a device in the figures is turned over, elements described as "below" or "beneath" other elements or features would then be "above" or "over" the other elements or features. Thus, the exemplary term "below" can encompass both positions and orientations of above and below. The devices may be otherwise oriented (rotated 90 degrees or at other orientations), and the spatially relative descriptors used herein interpreted accordingly. Likewise, descriptions of movement along and around various axes include various special device positions and orientations.

To avoid repetition in the figures and the descriptions of the various aspects and illustrative embodiments, it should be understood that many features are common to many aspects and embodiments. Omission of an aspect from a description or figure does not imply that the aspect is missing from embodiments that incorporate that aspect. Instead, the aspect may have been omitted for clarity and to avoid prolix description. In this context, the following applies to the rest of this description: If, in order to clarify the drawings, a figure contains reference signs which are not explained in the directly associated part of the description, then it is referred to previous or following description sections. Further, for reason of lucidity, if in a drawing not all features of a part are provided with reference signs it is referred to other drawings showing the same part. Like numbers in two or more figures represent the same or similar elements.

Hereinafter is provided a detailed description of exemplary embodiments of the present invention, i.e. of an exemplary sensomotoric hand therapy device and of a screen shot of an exemplary virtual reality game as used in the therapy system and hand training method.

Figure 1:
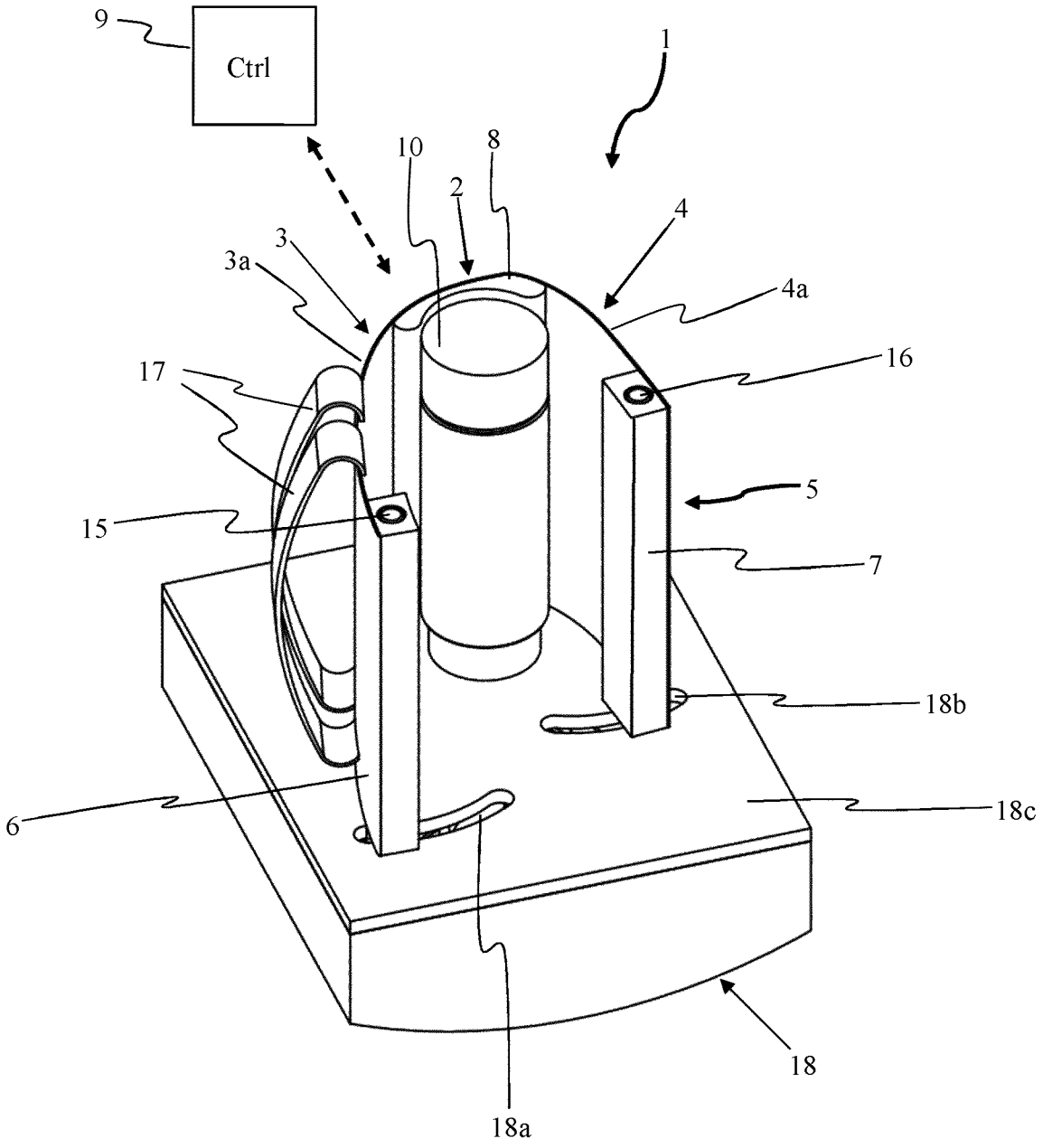
FIG. 1 shows a perspective view of an inventive sensomotoric hand therapy device, wherein the transmission is arranged within a transmission box.

FIG. 1 shows a perspective view of an inventive sensomotoric hand therapy device 1, wherein the transmission is arranged invisibly within transmission box 18. The shell 5 of the sensomotoric hand therapy device 1 comprises a first leg portion 3 and a second leg portion 4. The first leg portion 3 which is usually a flexible portion of the shell 5 comprises at its outer side two straps 17 which are provided for securely attaching the fingers of a human hand thereto. The first leg portion 3 is thus usually longer than the second leg portion 4 which is configured to accommodate the thumb of a human hand. A first reinforced member 6 is connected to the distal end region of the first leg portion 3 and a second reinforced member 7 is connected to the distal end region of the second leg portion 4. The first reinforced member 6 abuts at the base plate 18*c* and comprises an aluminium rod 15 which is guided in a first curved guiding slit 18*a* arranged in the base plate 18*c* and the second reinforced member 7 also abuts at the base plate 18*c* and comprises an aluminium rod 16 which is guided in a second curved guiding slit 18*b* arranged in the base plate 18*c*. The curved guiding slits 18*a* and 18*b* reflect the bending movement of the first and second reinforced member 5 and 6, respectively. The aluminium rods 15 and 16 provide the coupling of the first and second reinforced member 6, 7 to the (hidden) transmission unit. A third reinforced member 8 is provided in U-shaped portion 2 of shell 5 which is configured to accommodate a metacarpus of a human hand. The first and second leg portions 3 and 4 protrude from the third reinforced member 8. The rounded bottom shape of the device 1 allows performing pronosupination movements by tilting the device 1 to the left and to the right. The movements could for instance be measured by an inertial measurement unit. In this embodiment, the third reinforced member 8 accommodates a motor 10 for the movement mechanism of the sensomotoric hand therapy device 1. A control unit 9 is provided which controls the motor 10. The control unit 9 may be arranged within the transmission box 18 or may be remotely connected with the motor 10 (i.e. particularly in a wireless manner). The movement mechanism generally defines a course and resistance of movement of the first reinforced member 6 and the second reinforced member 7 relative to the third reinforced member 8 which is controlled by the control unit via motor 10. The movement mechanism usually comprises the motor 10 and the transmission unit 11 of sensomotoric hand therapy device 1 which will be described in the following.

Figure 2:
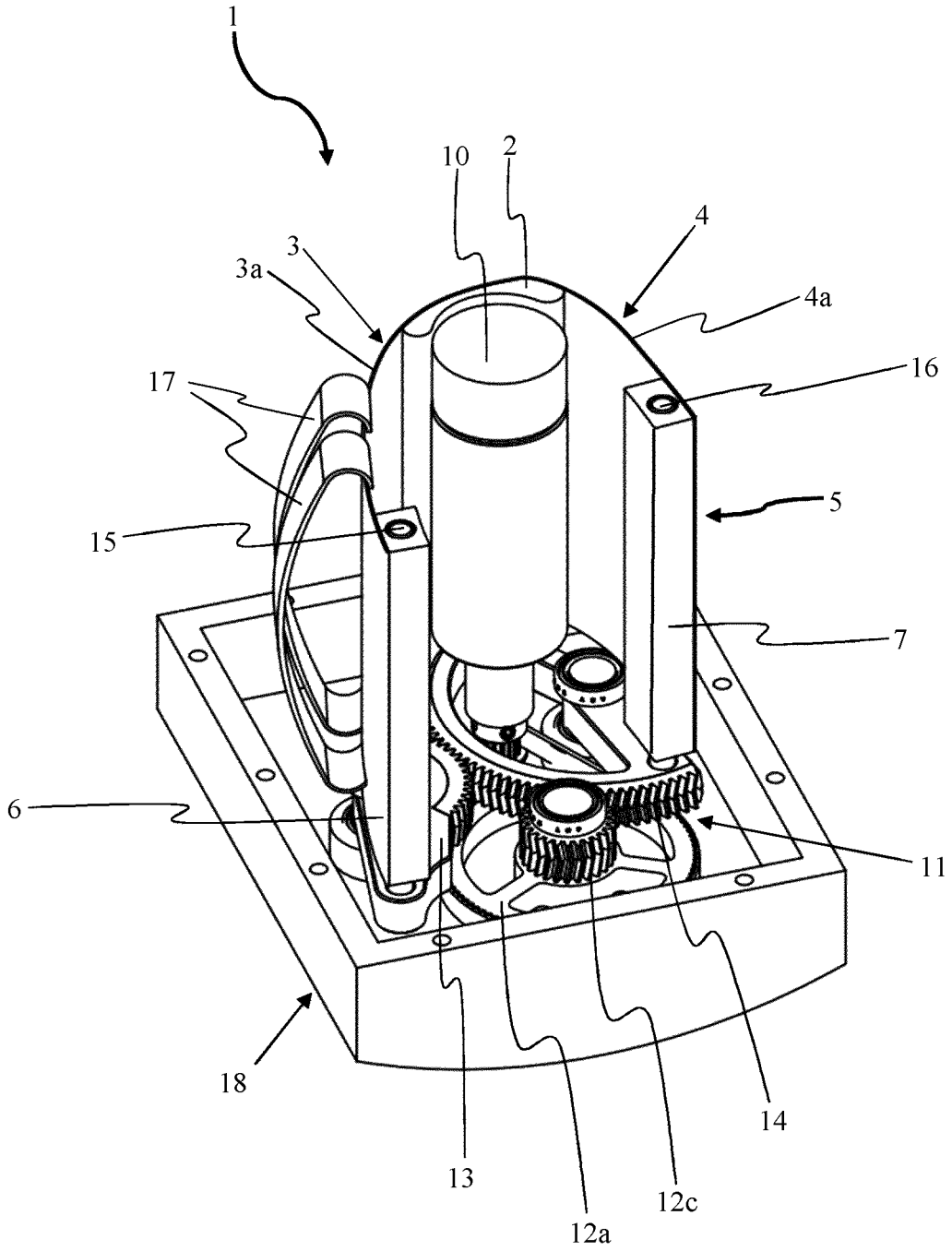
FIG. 2 shows a perspective view of the sensomotoric hand therapy device of FIG. 1, wherein the base plate of the transmission box has been removed in order to depict the transmission components.

In FIG. 2 the sensomotoric hand therapy device 1 of FIG. 1 is further illustrated, wherein the base plate 18*c* of the transmission box 18 has been removed in order to depict individual (upper) components of the transmission unit 11. As one can see, the first rod 15 of the first reinforced member 6 is operatively connected to a first herringbone gear member 13 and the second rod 16 of the second reinforced member 7 is operatively connected to a second herringbone gear member 14. Further, the second herringbone gear member 14 meshes with a herringbone gear wheel 12*c* which is arranged on the belt wheel 12*a* of the belt connection which is driven by the motor 10. Further, the second herringbone gear member 14 also meshes with the first herringbone gear member 13 such that a course and resistance of movement of the first reinforced member 6 and the second reinforced member 7 relative to the third reinforced member 8 is enabled.

Figure 3:
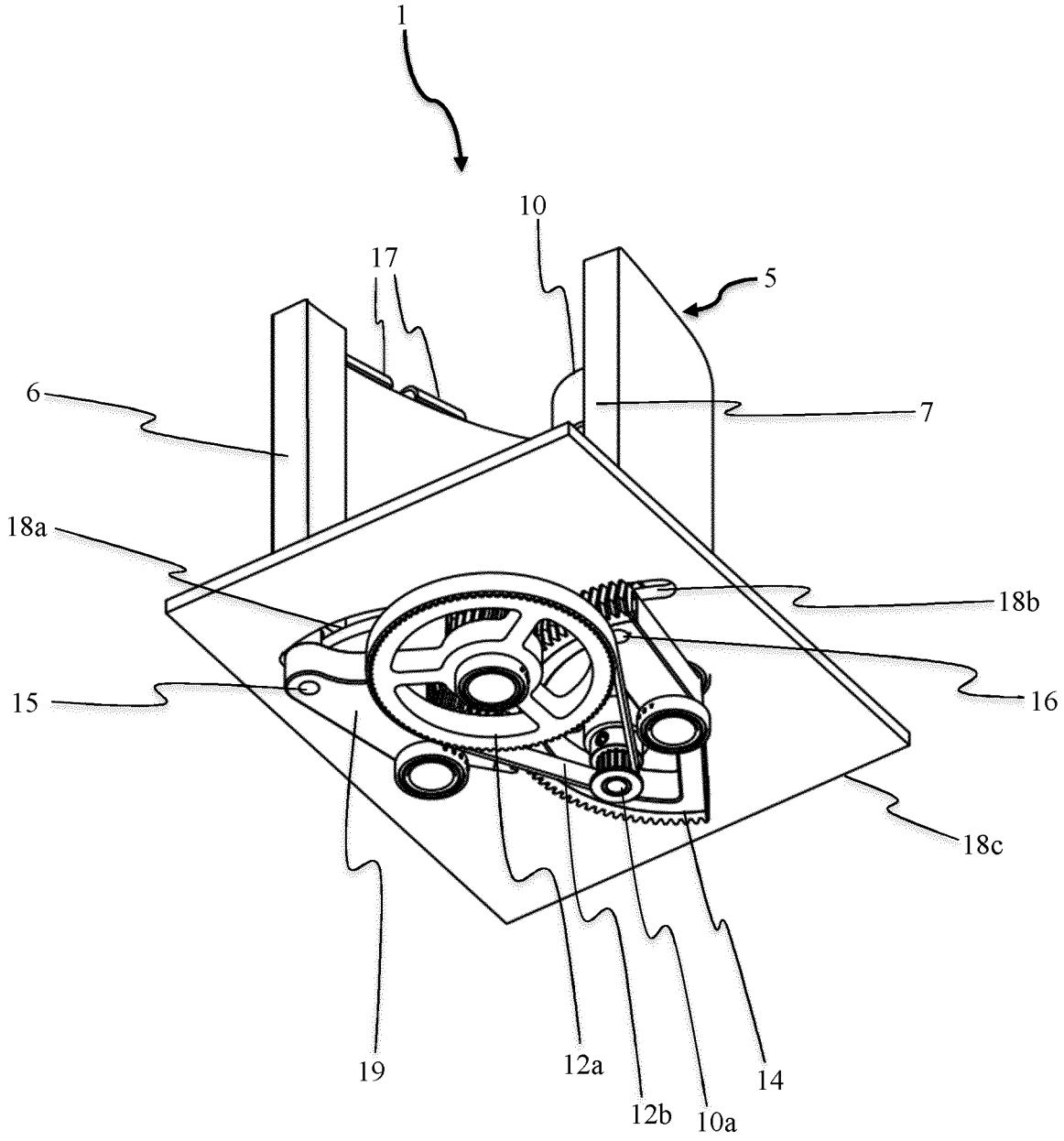
FIG. 3 shows a perspective bottom view of the sensomotoric hand therapy device of FIG. 1, wherein the transmission box has been removed in order to depict the arrangement of the belt connection of the transmission.

In FIG. 3 the sensomotoric hand therapy device 1 of FIG. 1 is further illustrated in a perspective bottom view with transmission box 18 being removed in order to depict individual (lower) components of the transmission unit 11. As one can see, the shaft 10*a* of the motor 10 and the belt wheel 12*a* of the belt connection are operatively connected by synchronous belt 12*b* which runs around both components. Thereby, the motor shaft 10*a* and the belt wheel 12*a* may comprise a toothed surface for better engagement with the synchronous belt 12*b*. The motor shaft 10*a* protrudes through a recess in the second herringbone gear member 14 which ensures that motor shaft 10*a* and belt wheel 12*a* are on the same level and which enables a space-saving construction of the transmission unit 11. The first herringbone gear member 13 and the second herringbone gear member 14 rotatably move together with the rods 15 and 16 when the rods 15 and 16 are moved along the respective guiding slits 18*a* and 18*b*. The belt wheel 12*a* is connected via connection member 19 to the first rod 15. The first herringbone gear member 13 is also rotatably arranged on the connection member 19.

Figure 4:
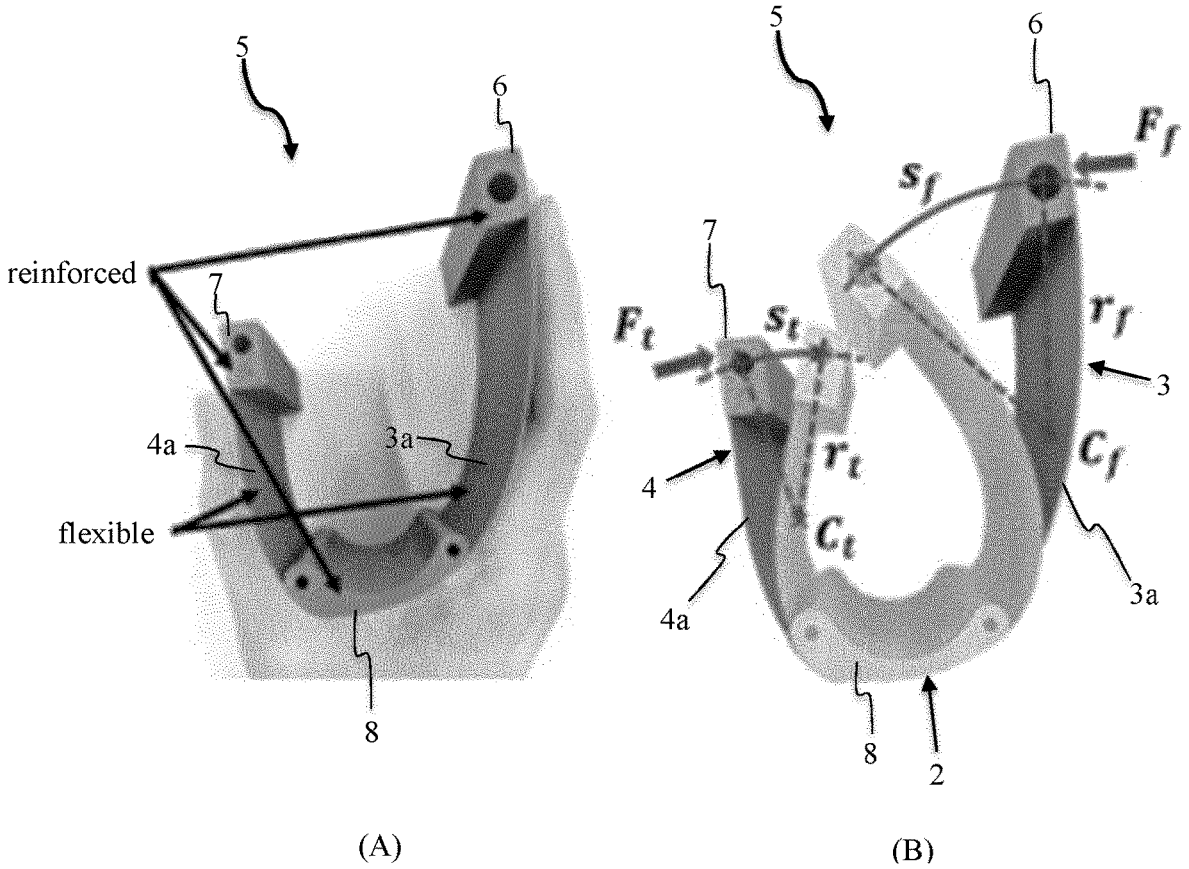
FIG. 4 shows in (A) a top view of an inventive shell gripped by a human hand and in (B) a schematic illustration of the bending of the shell when forces $F_t$ (exerted by the thumb) and $F_f$ (exerted by the fingertips) are applied.

FIG. 4 shows in (A) a top view of a shell 5 gripped by a human hand. The finger tips engage with first reinforced member 6 and the thumb engages with second reinforced member 7. The third reinforced member 8 is accommodated in the metacarpus of the human hand. Between the first reinforced member 6 and the third reinforced member 8 there is arranged flexible portion 3*a* and between the second reinforced member 7 and the third reinforced member 8 there is arranged flexible portion 4*a*. In (B) a schematic illustration of the bending of the shell 5 when forces $F_t$ (exerted by the thumb) and $F_f$ (exerted by the fingertips) are applied. Thereby, the first leg portion 3 which is essentially represented by the first flexible portion 3*a* and the first reinforced member 6 is bent by the force $F_f$ which is exerted by the fingertips in the inward direction as depicted by the corresponding arrow and the second leg portion 4 which is essentially represented by the second flexible portion 4*a* and the first reinforced member 7 is bent by the force $F_t$ which is exerted by the thumb also in the inward direction as depicted by the corresponding arrow. The U-shaped portion 2 with the third reinforced member 8 is substantially rigid and does not undergo bending (i.e. or only to a small degree).

The fingertips and the thumb tip can be considered to be approximately coincident with the shell endpoints, i.e. with the first reinforced member 6 and the second reinforced member 7, and move along the arcs with radii $r_t$ and $r_f$ and center points $C_t$ and $C_f$ as shown in (B). These parameters were defined in the iterative design process of the shell 5. Thereby, the thumb and fingertip displacements $s_t$ and $s_f$ were defined as arc lengths, with initial values $s_t$=0 mm and $s_f$=0 mm when the shell 5 is in maximum extension.

Figure 5:
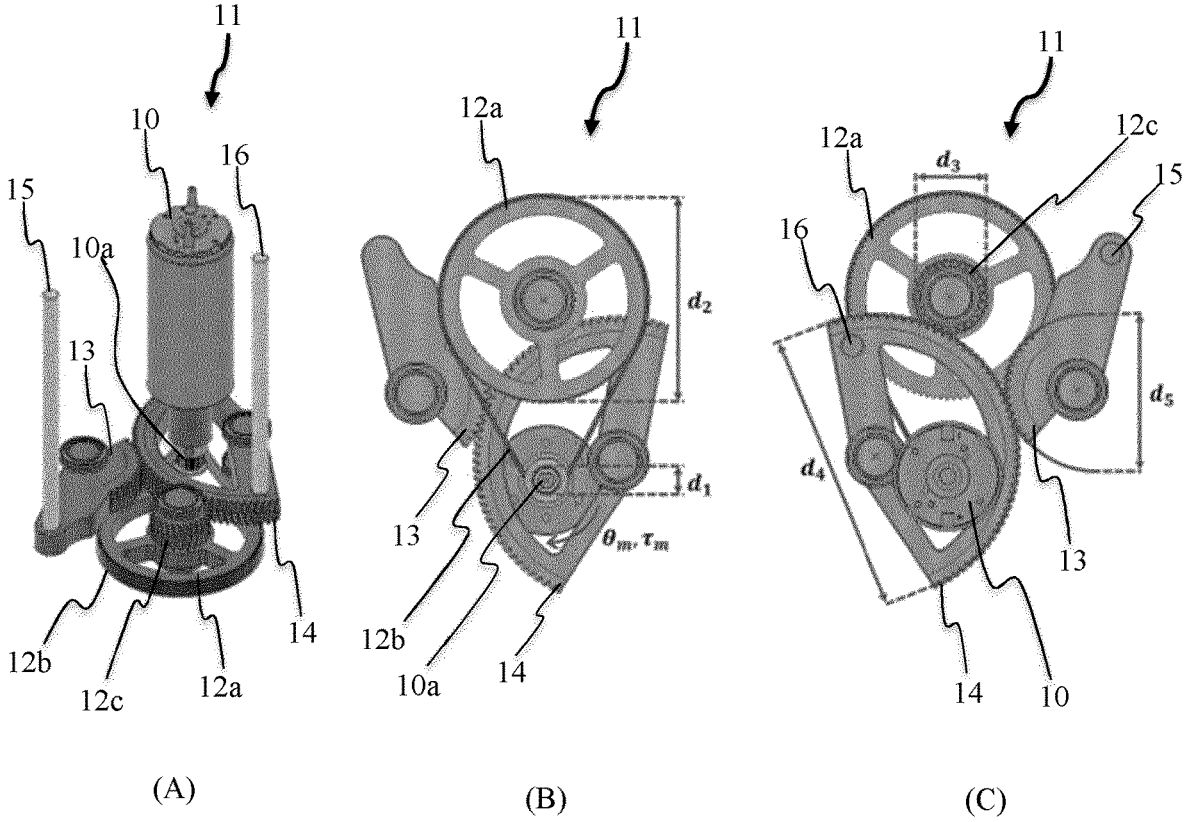
FIG. 5 shows in (A) a perspective view of the inventive transmission with the three transmission stages and the aluminium rods, in (B) a bottom view of the inventive transmission and in (C) a top view of the inventive transmission.

FIG. 5 shows in (A), (B) and (C) different views of the inventive transmission unit 11, with the three transmission stages and the. In (A) there is illustrated a perspective view of the first herringbone gear member 13, the second herringbone gear member 14 (with aluminium rods 15 and 16 connected thereto, respectively) and the belt connection with belt wheel 12*a*, synchronous belt 12*b* and the shaft 10*a* driven by motor 10. In (B) a respective bottom view is provided depicting in particular diameter $d_1$ of motor shaft 10*a* and diameter $d_2$ of belt wheel 12*a* and in (C) a respective top view depicting in particular diameter $d_3$ of herringbone gearwheel 12*c*, diameter $d_4$ of second herringbone gear member 14 and diameter $d_5$ of first herringbone gear member 13.

Given the motor shaft angle $\theta_m$ (as depicted in (B)) and the effective gear diameters $d_1$ to $d_5$, the displacement of the fingertips can be described as follows:

$$st = \frac{rt}{it}\theta_m \text{ with it} = \frac{d2d4}{d1d3} \tag{1a}$$

$$sf = \frac{rf}{if}\theta_m \text{ with if} = \frac{d2d5}{d1d3} \tag{1b}$$

The motor torque $\tau_m$ depends simultaneously on the thumb force $F_t$ and the finger force $F_f$, and is given by:

$$\tau m = \frac{\partial st}{\partial \theta m}Ft + \frac{\partial sf}{\partial \theta m}Ff = \frac{rt}{it}Ft + \frac{rf}{if}Ff \tag{2}$$

If it is assumed that an equal amount of grasping force F is applied at the thumb and the fingertips, i.e., $F_t=F_f=F$, it is obtained:

$$\tau m = r'F \text{ with } r' = \frac{rt}{it} + \frac{rf}{if} \tag{3}$$

This relation between $\tau_m$ and F is used to compute the required motor torque for simulated hand-object interaction forces.

Since a goal is a functional and believable rehabilitation or therapy game with rich haptic rendering, a three-dimensional game using has also been designed (cf. FIGS. 6 and 7 below). The game is played on a computer screen (but could eventually also be played with another computer device as for example a smartphone or tablet) and controlled using the sensomotoric hand therapy device 1 and an appropriate keyboard. Special attention was paid to the creation of dynamic, tangible game elements with a wide range of (adjustable) haptic characteristics. The interaction with those game elements was simulated by implementing a virtual wall, which is common practice for haptic devices. To consider the coupled movement of thumb and fingertips, firstly their combined displacement s and the speed s thereof was defined as:

$$s = st + sf = r'\theta m \tag{4a}$$

$$\dot{s} = \dot{s}t + \dot{s}f = r'\theta\dot{m} \tag{4b}$$

The rendered force $F_r$ is then computed in the rehabilitation game according to equation (5):

$$Fr = \begin{cases} K(s-so) + B\dot{s} & \text{for } s > so \text{ and } \dot{s} > 0 \\ K(s-so), & \text{for } s > so \text{ and } \dot{s} \leq 0 \\ 0, & \text{otherwise} \end{cases} \tag{5}$$

The values of the parameters K and B represent a virtual spring and a virtual viscous damping, and can be adjusted to render interactions with virtual objects with different dynamic characteristics. The parameter so indicates the combined finger displacement s right in the moment a tangible object is touched. By setting $F=-F_r$ in equation (3), the desired motor torque to render the haptic interaction can be computed.

As noted above, the transmission unit 11 consists of three stages. In the first stage, the synchronous belt 12*b* leads to a reduction ratio of 6:1 ($d_2$:$d_1$; FIG. 5 (B)). The second and third stage consist of second herringbone gear member 14 and first herringbone gear member 13 that couple the motion of the thumb and the fingers with transmission ratios of 3:1 ($d_4$:$d_3$; FIG. 5 (B)) and 1:2 ($d_5$:$d_3$), which leads to overall transmission ratios of $i_t$=18 and $i_f$=12 from equation (1).

Both the shell 5 and the components of the transmission unit 11 were manufactured by means of 3D-printing using poly-lactic acid (PLA). A DC motor 10 with integrated optical encoder (3272CR and IER3-4096, Faulhaber, Germany) with a continuous torque of 75 mNm was found to satisfy the torque requirements. Given the arc radii of $r_t$=34 mm and $r_f$=41 mm, it led to a maximum continuous force of F=14.1 N from equation (3). The motor 10 was placed inside the shell 5 resulting in a compact design that does not interfere with the shell 5 bending motion nor the patients' hand. Guiding slits 18*a*, 18*b* in the base plate 18*c* mechanically limit the displacement of the shell endpoints to $s_t$=20 mm and $s_f$=36 mm for the thumb and the fingers respectively, corresponding to an anatomical thumb and finger range of motion (ROM) of approximately [20, 53]° and [35, 85]°. The device is controlled by an ESP32 microcontroller (Espressif Systems, China) in combination with an Escon Module 50/5 motor controller (Maxon, Switzerland) and communicates with the host PC via USB.

Figure 6:
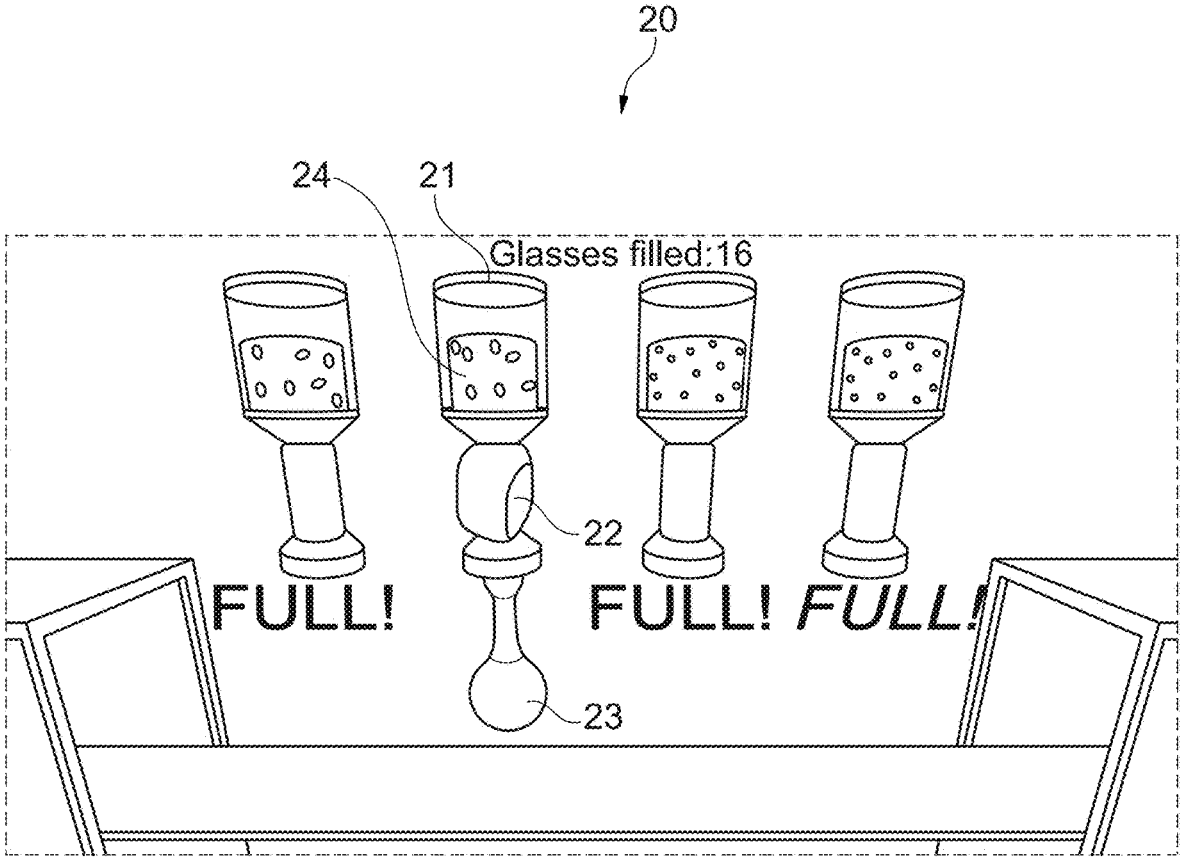
FIG. 6 shows a screen shot of an inventive virtual reality game with four liquid filled dispensers to be squeezed by a hand avatar.

FIG. 6 shows screen shot of an exemplary virtual reality game in accordance with the present invention with liquid filled dispensers 21 to be squeezed by a hand avatar 22. The goal of the task is to fill glasses 23 that appear on the screen as fast as possible by correctly squeezing the appropriate dispenser 21, i.e., with a determined fingertip force. Different dispensers contain liquids 24 of different viscosity. The number and position of the dispensers 21 are adjustable, while only one glass 23 at a time is visible to help patients direct their attention more easily to the dispenser 21 to be employed. Whenever a glass 23 is filled, a new one will spawn underneath a different dispenser 21. The text "FULL!" appears to signify that a glass has been filled. The dispensers 21 have different squeezing behaviours that are haptically rendered by the device. Such virtual reality hand therapy game incorporates all necessary elements, namely low complexity, believability, and adaptability of virtual elements with different rich haptic characteristics.

Squeezing the sensomotoric hand therapy device 1 causes a grasp to be initiated in the hand therapy game. When engaging in a grasping movement, the hand avatar 22 first moves forward and touches the dispenser 21. Once the hand avatar 22 encloses the dispenser (at a displacement of $s=s_0$), the hand-object interaction force is simulated by the virtual wall using equation (5), i.e., the user feels resistance as if a physical dispenser was grasped and squeezed. Thus, visual and haptic information is perceived when an interaction with a dispenser takes place. In order to promote the use of rich and diverse somatosensory information, each liquid and consequently each dispenser possesses different simulated properties—i.e., combinations of different values of K and B (up to K=2 N/mm and B=0.1 Ns/mm). Therefore, each dispenser has to be squeezed differently to fill the glass as fast as possible, i.e., different fingertip displacement and interaction forces are needed.

Figure 7:
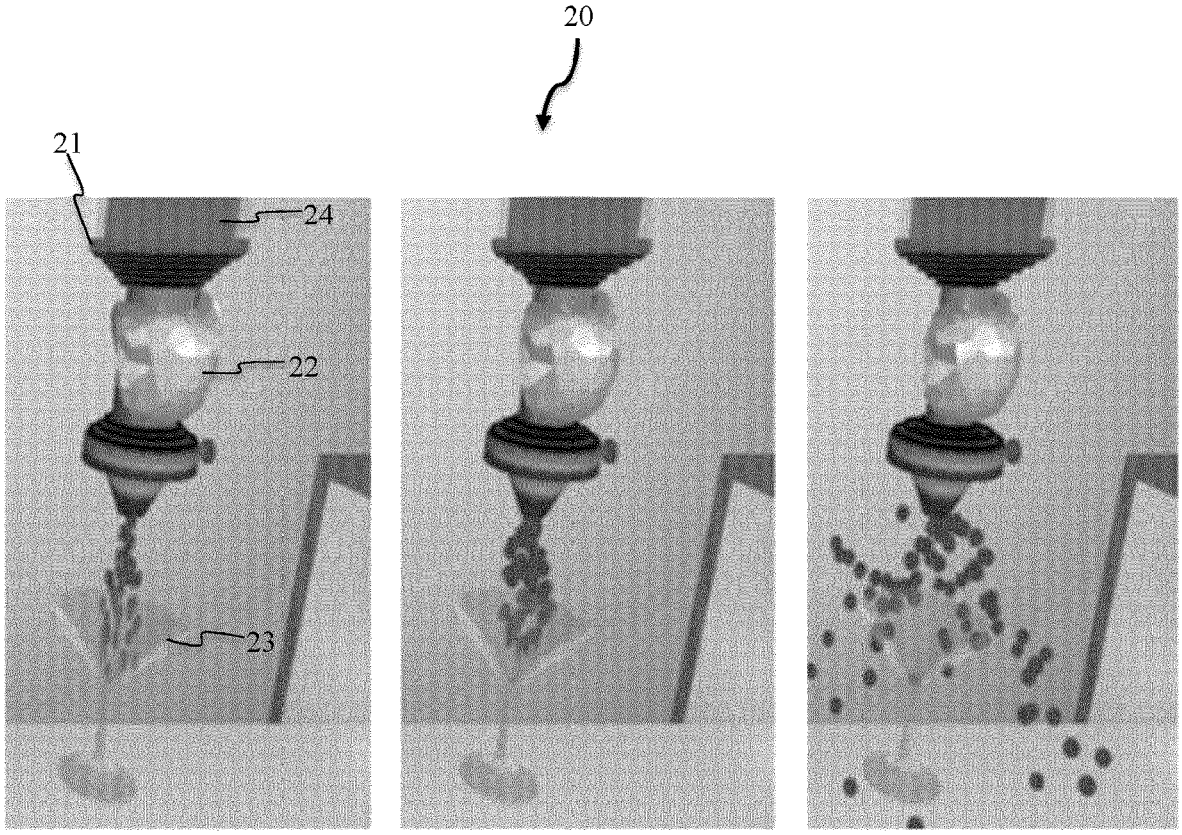
FIG. 7 shows in a sequence the results of different amounts of force applied to a dispenser, i.e. form too little (left) over optimal (middle) to too hard (right).

As illustrated in FIG. 7, if the dispenser 21 is squeezed too little, only a small amount of fluid is released, resulting in a slow filling speed. However, when squeezed too hard, the dispenser 21 starts sputtering and spilling the liquid outside of the glass 23. Whenever a glass is filled, the text "FULL!" appears and the next glass spawns. In order to move to a different dispenser 21, the hand has to be opened, i.e., fingers extended. Navigating to a different dispenser is then performed with the key arrows on a keyboard. The computation of the virtual wall is executed in a 1 kHz loop on the microcontroller. Numerical differentiation with consecutive first-order low-pass filtering using an Euler backwards discretization scheme is utilized to compute the speed of the motor shaft. Via a USB connection, the finger displacement s, computed by equation (4), is sent to the host computer where the hand therapy respectively rehabilitation game is played. The parameters K and B are then computed and sent to the control unit 9.

The portable one-degree-of freedom sensomotoric hand therapy device 1 is particularly useful for unsupervised hand rehabilitation after stroke based on the compliant shell design. The distinctive shell design that preferably consists of only one piece can safely be used regardless of patients' hand size. Its inherent safety stems from to the absence of pinching risks, its backdrivable transmission, limited ROM, and limited force. This potentially enables its application in an unsupervised setting. By placing the motor 10 inside the shell 5 and engineering a space-efficient transmission unit 11 we obtained a compact and portable device, which is beneficial for training at patients' home. Importantly, the device introduces the improvement of providing haptic rendering to portable devices. The present solution provides rich somatosensory input through the simulated interaction with a wide variety of virtual tangible objects, instead of e.g. only tactile vibration. The virtual reality hand therapy game provides a believable scenario and intuitive tasks. It is designed such that it encourages patients to haptically explore the behaviour of the different dispensers and use somatosensory feedback to perform the task. Similar to systems based on a real-time computer and a separate host computer, the inventive device does not require a realtime communication between the microcontroller and the host computer. An increased communication latency with the host computer could only lead to a delayed update of the parameters K and B, which hampers the quality of the simulated hand object interaction, but does not cause instability. Although a particularly low transmission ratio that minimizes reflected motor inertia and motor friction has been provided, the mechanical transparency of the transmission could also be achieved (or even improved) by replacing the 3D-printed gears with an alternative low-friction solution such as a cable transmission.

This description and the accompanying drawings that illustrate aspects and embodiments of the present invention should not be taken as limiting the claims defining the protected invention. In other words, while the invention has been illustrated and described in detail using examples in the drawings and foregoing description, such illustration and description are to be considered illustrative or exemplary and not restrictive. Various mechanical, compositional, structural, electrical, and operational changes may be made without departing from the spirit and scope of this description and the claims. In some instances, well-known circuits, structures and techniques have not been shown in detail in order not to obscure the invention. Thus, it will be understood that changes and modifications may be made by those of ordinary skill within the scope and spirit of the following claims. In particular, the present invention covers further embodiments with any combination of features from different embodiments described above and below.

The disclosure also covers all further features shown in the figures individually although they may not have been described in the afore or following description. Also, single alternatives of the embodiments described in the figures and the description and single alternatives of features thereof can be disclaimed from the subject matter of the invention or from disclosed subject matter. The disclosure comprises subject matter consisting of the features defined in the claims or the exemplary embodiments as well as subject matter comprising said features.

Furthermore, in the claims the word "comprising" does not exclude other elements or steps, and the indefinite article "a" or "an" does not exclude a plurality. A single unit or step may fulfil the functions of several features recited in the claims. The mere fact that certain measures are recited in mutually different dependent claims does not indicate that a combination of these measures cannot be used to advantage. The terms "essentially", "about", "approximately" and the like in connection with an attribute or a value particularly also define exactly the attribute or exactly the value, respectively. The term "about" in the context of a given numerate value or range refers to a value or range that is, e.g., within 20%, within 10%, within 5%, or within 2% of the given value or range. Components described as coupled or connected may be electrically or mechanically directly coupled, or they may be indirectly coupled via one or more intermediate components. Any reference signs in the claims should not be construed as limiting the scope.

A computer program may be stored/distributed on a suitable medium, such as an optical storage medium or a solid-state medium supplied together with or as part of other hardware, but may also be distributed in other forms, such as via the Internet or other wired or wireless telecommunication systems. In particular, e.g., a computer program can be a computer program product stored on a computer readable medium which computer program product can have computer executable program code adapted to be executed to implement a specific method such as the method according to the invention. Furthermore, a computer program can also be a data structure product or a signal for embodying a specific method such as the method according to the invention.

LIST OF REFERENCE SIGNS

1 sensomotoric hand therapy device
2 U-shaped portion
3 first leg portion
3*a* first flexible section
4 second leg portion
4*a* second flexible section
5 flexible shell
6 first reinforced member (fingertips)
7 second reinforced member (thumb)
8 third reinforced member
9 control unit
10 motor
10*a* motor shaft
11 transmission unit
12*a* belt wheel
12*b* synchronous belt
12*c* herringbone gearwheel
13 first herringbone gear member
14 second herringbone gear member
15 first connection member/rod
16 second connection member/rod
17 finger straps
18 transmission box
18*a* guiding slit (curved)
18*b* guiding slit (curved)
18*c* base plate
19 connection member
20 screen computer device
21 deformable object/dispenser
22 hand avatar
23 virtual glass
24 virtual liquid
$d_1$ diameter motor shaft
$d_2$ diameter belt wheel
$d_3$ diameter gear wheel
$d_4$ diameter first herringbone gear member
$d_5$ diameter second herringbone gear member
$C_t$ center point of bending by thumb (second leg)
$C_f$ center point of bending by fingertips (first leg)
F grasping force
$F_t$ force exerted by thumb on second reinforced member
$F_f$ force exerted by fingertips on first reinforced member $r_t$ arc radius thumb (from Ct to second reinforced member)

$r_f$ arc radius fingertips (from Cf to first reinforced member)

$s_t$ displacement thumb (second reinforced member)

$s_f$ displacement fingertips (first reinforced member)

The invention claimed is:

1. A sensomotoric hand therapy device comprising:

a flexible shell having a first leg portion configured to accommodate fingers of a hand of a patient, a second leg portion configured to accommodate a thumb of the patient and a U-shaped portion configured to accommodate a metacarpus of the patient;

a first reinforced member connected to a distal end region of the first leg portion of the shell;

a second reinforced member connected to a distal end region of the second leg portion of the shell;

a third reinforced member connected to and reinforcing the U-shaped portion of the shell; and a movement mechanism defining a course and resistance of movement of the first reinforced member and the second reinforced member relative to the third reinforced member.

2. The sensomotoric hand therapy device according to claim 1, wherein the movement mechanism comprises a motor to define the resistance of movement of the first reinforced member and the second reinforced member relative to the third reinforced member.

3. The sensomotoric hand therapy device according to claim 2, comprising a control unit, wherein the control unit controls the motor of the movement mechanism to define the resistance of movement of the first reinforced member and the second reinforced member relative to the third reinforced member as a function of a displacement of the first reinforced member and the second reinforced member relative to the third reinforced member.

4. The sensomotoric hand therapy device according to claim 3, wherein the control unit controlling the motor comprises controlling a torque of the motor.

5. The sensomotoric hand therapy device according to claim 3, wherein the control unit comprises a function for computing a motor torque which includes a product of a relative radius and a resisting force and which defines the resistance of movement.

6. The sensomotoric hand therapy according to claim 5, wherein the relative radius comprises a sum of an arc radius of the second reinforced member of the shell divided by an overall transmission ratio related to the second reinforced member of the flexible shell and of an arc radius of a first reinforced member of the shell divided by an overall transmission ratio related to the first reinforced member of the shell.

7. The sensomotoric hand therapy device according to claim 6, wherein the overall transmission ratio related to the second reinforced member of the shell is between 14 and 22.

8. The sensomotoric hand therapy device according to claim 6, wherein an overall transmission ratio related to the first reinforced member of the shell is between 8 and 16.

9. The sensomotoric hand therapy device according to claim 2, wherein the shaft of the motor has a first diameter, the belt wheel has a second diameter, the gear wheel has a third diameter, the first herringbone gear member has a fourth diameter and the second herringbone gear member has a fifth diameter.

10. The sensomotoric hand therapy device according to claim 1, wherein the movement mechanism comprises a multi-stage transmission unit for transmitting motor torque force.

11. The sensomotoric hand therapy device according to claim 10, wherein the transmission unit comprises a first stage, a second stage, and a third stage.

12. The sensomotoric hand therapy device according to claim 11, wherein the first stage is in the form of a belt connection, the second stage is in the form of a first herringbone gear member, and the third stage is in the form of a second herringbone gear member.

13. The sensomotoric hand therapy device according to claim 12, wherein the transmission unit is connected to the first reinforced member by means of a first connection member being arranged on the first herringbone gear member and to the second reinforced member by means of a second connection member being arranged on the second herringbone gear member.

14. The sensomotoric hand therapy device according to claim 8, wherein the first connection member and the second connection member are in the form of a rod, respectively.

15. The sensomotoric hand therapy device according to claim 12, wherein the belt connection comprises a first belt wheel, a motor shaft and a synchronous belt, and wherein the first belt wheel carries a herringbone gear wheel.

16. The sensomotoric hand therapy device according to claim 15, wherein the first belt wheel is operatively connected to the motor shaft by the synchronous belt, wherein the second herringbone gear member meshes with the herringbone gear wheel on the first belt wheel and wherein the first herringbone gear member meshes with the second herringbone gear member.

17. The sensomotoric hand therapy device according to claim 1, wherein the shell is configured to provide a physiological power grasp of the hand of the patient.

18. A therapy system comprising a sensomotoric hand therapy device according to claim 1 and a computer device configured for executing a virtual reality hand therapy game thereon.

19. The therapy system according to claim 18, wherein the virtual reality hand therapy game is configured to compute a rendered force on the basis of the combined displacement and speed of the first reinforced member and the second reinforced member and by further considering parameters representing a virtual spring and a virtual viscous damping.

20. A method for training a hand of a patient, comprising the steps of:

providing a sensomotoric hand therapy device according to claim 1;

providing a computer device with a virtual reality hand therapy game installed thereon;

executing a game task by means of a hand avatar on a screen of the computer device, the task requiring specific interaction forces to be applied from the sensomotoric hand therapy device via the hand avatar to a virtually deformable object on the screen of the computer device; and squeezing the virtually deformable object with the hand avatar until a predetermined threshold value for the specific interaction forces has been reached.

21. The method according to claim 20, wherein the virtually deformable object comprises a dispenser filled with a virtual liquid wherein the dispenser is configured to be squeezed in order to fill a virtual glass arranged underneath the dispenser with the virtual liquid until a maximum fill level has been reached.

* * * * *